US008387820B2

(12) United States Patent
Park

(10) Patent No.: US 8,387,820 B2
(45) Date of Patent: Mar. 5, 2013

(54) TRAVEL MUG FOR MICROWAVE OVEN

(76) Inventor: Jong Peter Park, Pasadena, CA (US)

( * ) Notice: Subject to any disclaimer, the term of this patent is extended or adjusted under 35 U.S.C. 154(b) by 175 days.

(21) Appl. No.: 12/938,681

(22) Filed: Nov. 3, 2010

(65) Prior Publication Data

US 2012/0080439 A1 Apr. 5, 2012

(30) Foreign Application Priority Data

Oct. 7, 2010 (KR) ..... 10-2010-0097769

(51) Int. Cl.
*B65D 1/20* (2006.01)
*A47G 19/22* (2006.01)

(52) U.S. Cl. ..... 220/710.5; 220/714; 222/468

(58) Field of Classification Search ..... 220/710.5, 220/709, 705, 221.5, 714; 222/380, 383.1, 222/175, 464.1, 465.1, 324, 468; 99/352
See application file for complete search history.

(56) References Cited

U.S. PATENT DOCUMENTS 2,876,634 A * 3/1959 Zimmerman et al. ..... 62/457.3
3,463,140 A * 8/1969 Rollor, Jr. ..... 126/246
4,402,195 A * 9/1983 Campbell ..... 62/457.3
5,088,179 A * 2/1992 Gibbon ..... 29/458
5,135,132 A * 8/1992 Potochnik ..... 220/592.16
5,169,016 A * 12/1992 Hinz, Jr. ..... 222/506
5,508,498 A * 4/1996 Rheinish et al. ..... 219/730
5,515,995 A * 5/1996 Allen et al. ..... 220/592.16
5,918,761 A * 7/1999 Wissinger ..... 220/713
6,386,431 B1 * 5/2002 Lin ..... 228/223
6,802,438 B2 * 10/2004 Thompson ..... 222/175
2004/0232144 A1 * 11/2004 Edmark ..... 219/735
2006/0219712 A1 * 10/2006 Ramirez ..... 219/730
2009/0108029 A1 * 4/2009 Fromm ..... 222/324

* cited by examiner

*Primary Examiner* — J. Gregory Pickett
*Assistant Examiner* — Ernesto Grano
(74) *Attorney, Agent, or Firm* — East West Law Group, PC; Heedong Chae

(57) ABSTRACT

The present invention relates to a travel mug that is made of metal materials and can be used for microwave oven, comprising: a container having a double-layered structure with an inner shell and an outer shell, wherein said inner shell and said outer shell are joined by a joint in such a way that a cavity is provided therebetween, and a heat transfer medium is filled to at least part of said cavity; a first neat transfer member and a second transfer member formed from the bottom of said outer shell; a handle formed on one side of said outer shell; a pressure release device formed at one side of said outer shell; and a lid having a receiver part forming a concave portion to receive said joint.

4 Claims, 4 Drawing Sheets

TRAVEL MUG FOR MICROWAVE OVEN

TECHNICAL FIELD

The present invention relates to a travel mug for microwave oven, and more particularly, to a travel mug that is made of metal materials and can be used in a microwave oven.

BACKGROUND OF THE INVENTION

Typical containers used in a microwave oven are made of materials that electromagnetic waves can pass, and the materials may be, for example, glass, ceramic, resin, etc.

Materials such as metal that blocks the passing of electromagnetic waves cannot be used in a microwave oven.

However, containers made of metal are very effective for cooking food, not just for simply defrosting food.

A cooking bowl made of resin, not metal, is disclosed in Korean Patent Laid-Open No. 10-2005-0115981. This application relates to a cooking bowl for the microwave oven range, and teaches a cooking bowl with an electric wave absorber, which is formed on a lower part, in a bowl made of resin having heat resistance.

Further, as examples for cooking food in a container made of metal, US Patent Publication No. US2004/0094544 teaches a cooking vessel for heating water by the heat of the lower part of a container, which is located on the lower surface and made of a microwave permeable material, in a structure where a metal lid blocks microwaves, and US Patent Publication No. US2004/0118838 was filed and published in the name of the applicant of the present application, and teaches a vessel for cooking food by using a heating element that is made of ferrite rubber on the lower surface of the vessel made of a heat conductive material.

Meanwhile, such metal bowls have been used to cook food, but a metal travel mug has not been used yet for microwave oven because the material is made of metal such as stainless steel, and when food within the mug gets cold, the mug cannot be used to warm the food up using microwave oven.

Since the size of a mug for microwave oven is very small compared to typical cooking containers, a structure that can be used for microwave oven cannot be made with conventional techniques for cooking containers.

SUMMARY OF THE INVENTION

The present invention contrives to solve the disadvantages of the prior art.

Problems to be Solved

The present invention is designed to solve the above problem, and aims to provide a travel mug for microwave oven that can be used for heating and cooking food within the mug fast and keep it warm for a long time.

Technical Means for Solving the Problems

In order to achieve the above object, the present invention provides a travel mug for microwave oven, comprising: a container having a double-layered structure with an inner shell and an outer shell, wherein said inner shell and said outer shell are joined by a joint in such a way that a cavity is provided therebetween, and a heat transfer medium is filled to at least part of said cavity; a first heat transfer member and a second transfer member formed from the bottom of said outer shell; a handle formed on one side of said outer shell; a pressure release device formed at one side of said outer shell; and a lid having a receiver part forming a concave portion to receive said joint.

Also, the present invention provides a travel mug for microwave oven characterized in that said heat transfer medium is silicon oil.

In addition, the present invention provides a travel mug for microwave oven characterized in that said first heat transfer member is made of ferrite.

Moreover, the present invention provides a travel mug for microwave oven characterized in that said second heat transfer member is made of silicon rubber.

Furthermore, the present invention provides a travel mug for microwave oven characterized in that said pressure release device is installed inside a handle on one side of the outer shell and comprises a bracket fixedly installed with a fixing part at one side of the handle, and a valve member installed within said bracket, wherein said valve member comprises a body being hollow and cylindrical, a neck, being hollow and cylindrical, with the smallest outer diameter and with its length being the same as the thickness of the outer shell, and a head being tapered forwardly, said neck being inserted into an opening formed on the outer shell.

Effects of the Invention

According to the present invention, a travel mug for microwave oven can be easily used for microwave oven.

Also, according to the present invention, it is possible to heat and cook food within a travel mug fast, and keep the food warm for a long time.

In addition, according to the present invention, the inner pressure in an air pocket is controlled by releasing overpressure formed within the double-layered structure of the travel mug so as to prevent deformation or explosion of the body of the travel mug.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

All the contents of U.S. Pat. No. 6,191,393 issued on Dec. 2, 2001, U.S. Pat. No. 6,467,645 issued Oct. 22, 2002, U.S. Pat. No. 6,631,824 issued on Oct. 14, 2003, U.S. Pat. No. 6,698,337 issued on Mar. 2, 2004, U.S. Design Pat. No. 486,352 issued on Feb. 10, 2004, U.S. Design Pat. No. 487,212 issued on Mar. 2, 2004, Korean Patent Publication No. 10-2005-0115981, US Patent Publication No. 2004/0094544, and US Patent Publication No. 2004/0118838 are incorporated herein by reference.

Hereinafter, the present invention will be described in detail with reference to the drawings.

Figure 1:
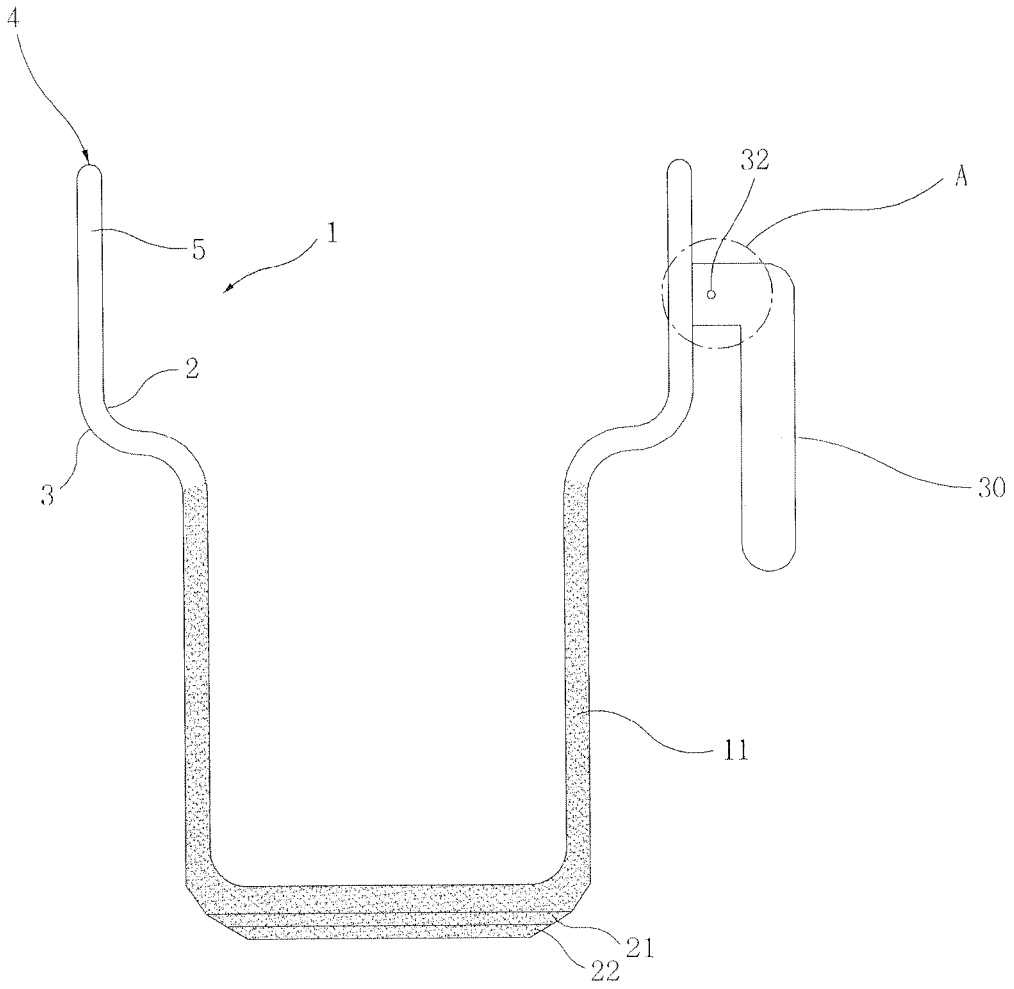
FIG. 1. shows a cross-sectional view of a travel mug for microwave oven according to the present invention.

FIG. 1. shows a cross-sectional view of a travel mug for microwave oven according to the present invention.

A container (1) of the travel mug according to the present invention has a double-layered structure with an inner shell (2) and an outer shell (3), wherein the inner shell and the outer shell are joined by a joint (4) of the upper part of the container (1) of the travel mug to seal a cavity (5).

The inner shell (2) and outer shell (3) are preferably made of stainless steel, and a joint (4) may be made by electronic welding.

A heat transfer medium (11) is provided within at least part of the cavity (5) of the container (1).

The heat transfer medium (11) is preferably silicon oil.

Since silicon oil has an advantage for maintaining a melting point of −25° C. and a boiling point of 200° C., a heat preserving rate of 70% or more can be maintained after four hours have been passed.

On the bottom surface of the container (1) of the travel mug, a first heat transfer member (21) is formed at the bottom part of the outer shell (3), and a second heat transfer member (22) is formed below the first heat transfer member (21).

The first heat transfer member (21) is preferably made of a ferrite compound, and particularly, Mn—Zn ferrite, and is made into a slurry state and coated on the lower part of the outer shell (3).

The second heat transfer member (22) is preferably made of silicon rubber, and is formed by pressure-welding by press onto the bottom part of the first heat transfer member (21).

Silicon rubber converts electronic wave energy into heat energy so as to fast heat or cook food within the mug and keep the food warm or cool for a long time.

When the travel mug for microwave oven according to the present invention is put in a microwave oven and heated, the second heat transfer member (22) absorbs high-frequency energy, converts it into heat energy, and transfers the heat energy to the first heat transfer member (21) to heat the heat transfer medium (11) in the cavity (5) of the container (1), thereby heating the food in the travel mug for microwave oven.

A handle (30) installed on the external circumference of the container (1) of the travel mug is made of silicon materials so as to prevent the handle from being heated and slippery.

A discharge hole (32) is formed at a proper location on a side of the handle (30).

A pressure release device is installed at a proper location on the external circumference of the container (1).

The pressure release device may be installed within the handle (30).

Figure 2:
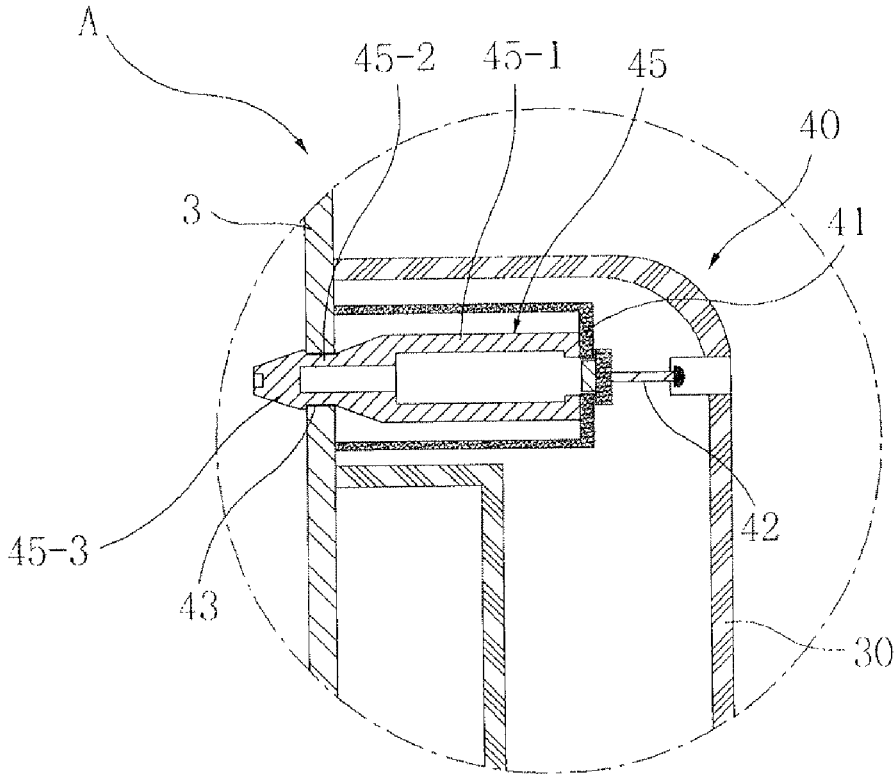
FIG. 2 shows a detailed view of a pressure release device according to the present invention.

FIG. 2 shows a detailed view of one example of the pressure release device (40).

A bracket (41) is installed within the handle (30) on one side of the outer shell (3), and this bracket (41) is affixed onto one side of the handle (30) by a fixing part (42).

The fixing part (42) is preferably a screw.

The bracket (41) and fixing part (42) are preferably made of stainless steel.

A valve member (45) is installed within the bracket (41).

The valve member (45) is installed by inserting it into an opening (43) formed within the bracket (41) on the outer shell (3).

The valve member (45) comprises a body (45-1), a neck (45-2), and a head (45-3), the body (45-1) being hollow and cylindrical, the head (45-3) being tapered forwardly, and the neck (45-2) being hollow and cylindrical with the smallest outer diameter and with its length being the same as the thickness of the outer shell (3).

At normal times, the neck (45-2) is inserted into the outer shell (3, the head (45-3) inserted into the cavity (5), and an end of the body (45-1) connected to the bracket (41).

If the temperature increases, the heat transfer medium (11) within the cavity (4) is heated and thus, the pressure of the vapor steam in it exceeds a predetermined level, the valve member (45) is pushed to the right, and the opening (43) is opened, thereby releasing the vapor steam through the opening (43) and discharge hole (32) so as to release the pressure within the cavity (5).

Once the pressure has decreased, the valve member (45) returns to its original state by its elastic property so as to block the opening (43) again.

The inner pressure within the cavity (5) is released by releasing the overpressure formed within the cavity (5) so as to prevent deformation and explosion of the body of the travel mug.

Hereinafter, a lid of the travel mug according to the present invention will be described.

Figure 3A:
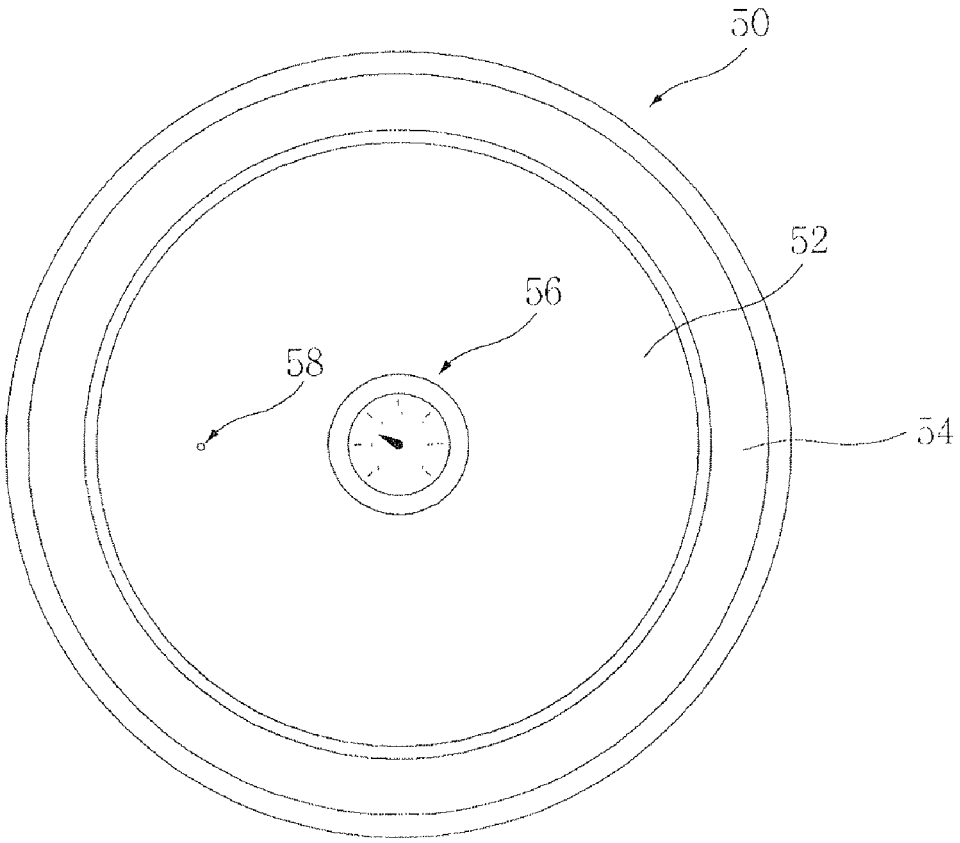
FIG. 3*a* shows a plane view of a lid of the travel mug for microwave oven according to the present invention.
Figure 3B:
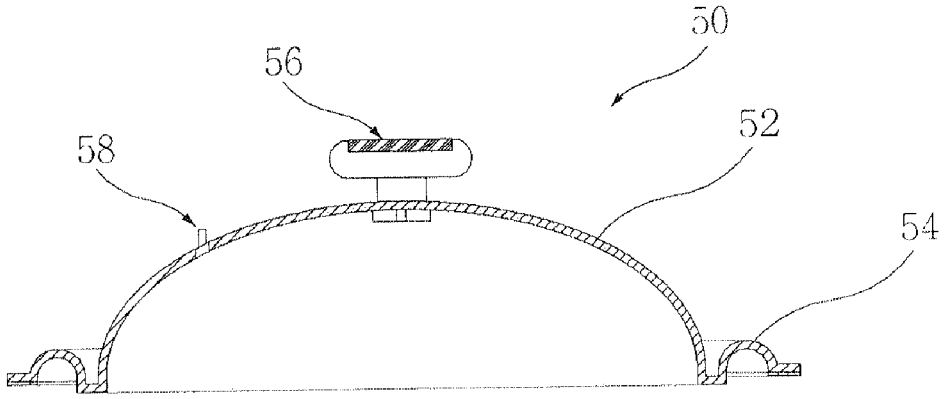
FIG. 3*b* shows a cross-sectional view of the lid of the travel mug for microwave oven according to the present invention.

FIG. 3*a* shows a plane view of a lid of the travel mug, and FIG. 3*b* shows a cross-sectional view of the lid of the travel mug.

The lid body (52) of a lid (50) of the travel mug is in a dome-shaped form, and comprises a receiver part (54) constituting a concave portion around the edge to receive a joint (4) of the travel mug.

The lid body (52) is preferably made of silicon rubber. On the upper surface of the lid body (52), a timer (56) may be installed, and a discharge hole (58) is formed on a proper location.

The travel mug for microwave oven according to the present invention is effective and economic because it enables office workers who are busy in business to cook rice porridge, soup, or rice as breakfast or lunch in an office.

In addition, since the effect of cooling is the same, the travel mug can be used for keeping food cold for a long time.

The embodiments of the present invention described above are only for examples, but the present invention is not limited to these embodiments. Various other changes and modifications can be made without departing from the spirit and scope of the invention. The present invention is not limited by the description described above, but only limited by the scope of the claims attached herewith.

REFERENCE NUMERICAL NUMBERS

1: container
11: heat transfer medium
21: first heat transfer member
22: second heat transfer member
30: handle
40: pressure release device
45: valve member
50: lid

What is claimed is:

1. A travel mug for microwave oven, comprising:

a container (1) having a double-layered structure with an inner shell (2) and an outer shell (3), wherein said inner shell (2) and said outer shell (3) are joined by a joint (4) in such a way that a cavity (5) is provided therebetween, and a heat transfer medium (11) is filled to at least part of said cavity (5);

a first heat transfer member (21) and a second transfer member (22) formed from the bottom of said outer shell (3);

a handle (30) formed on one side of said outer shell (3);

a pressure release device (40) formed at one side of said outer shell (3); and a lid (50) having a receiver part (54) forming a concave portion to receive said joint (4), wherein said pressure release device (40) is installed inside the handle (30) on one side of the outer shell and comprises a bracket (41) fixedly installed with a fixing part at one side of the handle (30), and a valve member (45) installed within the bracket (41), wherein said valve member (45) comprises a body (45-1) being hollow and cylindrical, a neck (45-2), being hollow and cylindrical, with a smallest outer diameter and with its length being the same as the thickness of the outer shell (3), and a head (45-3) being tapered forwardly, said neck (45-2) being inserted into an opening (43) formed on the outer shell (3).

2. A travel mug for microwave oven, comprising:

a container (1) having a double-layered structure with an inner shell (2) and an outer shell (3), wherein said inner shell (2) and said outer shell (3) are joined by a joint (4) in such a way that a cavity (5) is provided therebetween, and a heat transfer medium (11) is filled to at least part of said cavity (5);

a first heat transfer member (21) and a second transfer member (22) formed from the bottom of said outer shell (3);

a handle (30) formed on one side of said outer shell (3);

a pressure release device (40) formed at one side of said outer shell (3); and a lid (50) having a receiver part (54) forming a concave portion to receive said joint (4), wherein said second heat transfer member (22) is made of silicon rubber, and wherein said pressure release device (40) is installed inside the handle (30) on one side of the outer shell and comprises a bracket (41) fixedly installed with a fixing part at one side of the handle (30), and a valve member (45) installed within the bracket (41), wherein said valve member (45) comprises a body (45-1) being hollow and cylindrical, a neck (45-2), being hollow and cylindrical, with the smallest outer diameter and with its length being the same as the thickness of the outer shell (3), and a head (45-3) being tapered forwardly, said neck (45-2) being inserted into an opening (43) formed on the outer shell (3).

3. A travel mug for microwave oven, comprising:

a container (1) having a double-layered structure with an inner shell (2) and an outer shell (3), wherein said inner shell (2) and said outer shell (3) are joined by a joint (4) in such a way that a cavity (5) is provided therebetween, and a heat transfer medium (11) is filled to at least part of said cavity (5);

a first heat transfer member (21) and a second transfer member (22) formed from the bottom of said outer shell (3);

a handle (30) formed on one side of said outer shell (3);

a pressure release device (40) formed at one side of said outer shell (3); and a lid (50) having a receiver part (54) forming a concave portion to receive said joint (4), wherein said first heat transfer member (21) is made of ferrite, and wherein said pressure release device (40) is installed inside the handle (30) on one side of the outer shell and comprises a bracket (41) fixedly installed with a fixing part at one side of the handle (30), and a valve member (45) installed within the bracket (41), wherein said valve member (45) comprises a body (45-1) being hollow and cylindrical, a neck (45-2), being hollow and cylindrical, with a smallest outer diameter and with its length being the same as the thickness of the outer shell (3), and a head (45-3) being tapered forwardly, said neck (45-2) being inserted into an opening (43) formed on the outer shell (3).

4. A travel mug for microwave oven, comprising:

a container (1) having a double-layered structure with an inner shell (2) and an outer shell (3), wherein said inner shell (2) and said outer shell (3) are joined by a joint (4) in such a way that a cavity (5) is provided therebetween, and a heat transfer medium (11) is filled to at least part of said cavity (5);

a first heat transfer member (21) and a second transfer member (22) formed from the bottom of said outer shell (3);

a handle (30) formed on one side of said outer shell (3);

a pressure release device (40) formed at one side of said outer shell (3); and a lid (50) having a receiver part (54) forming a concave portion to receive said joint (4), wherein said heat transfer medium (11) is silicon oil, and wherein said pressure release device (40) is installed inside the handle (30) on one side of the outer shell and comprises a bracket (41) fixedly installed with a fixing part at one side of the handle (30), and a valve member (45) installed within the bracket (41), wherein said valve member (45) comprises a body (45-1) being hollow and cylindrical, a neck (45-2), being hollow and cylindrical, with a smallest outer diameter and with its length being the same as the thickness of the outer shell (3), and a head (45-3) being tapered forwardly, said neck (45-2) being inserted into an opening (43) formed on the outer shell (3).

* * * * *